United States Patent [19]

Gamm

[11] 4,312,076

[45] Jan. 26, 1982

[54] CAP WITH INTEGRAL POCKET

[75] Inventor: Robert J. Gamm, Olivette, Mo.

[73] Assignee: Envoys U.S.A., Inc., St. Louis, Mo.

[21] Appl. No.: 195,330

[22] Filed: Oct. 9, 1980

[51] Int. Cl.[3] ..... A42B 1/24

[52] U.S. Cl. ..... 2/199

[58] Field of Search ..... 2/199, 196, 185 R, 209.1, 2/10

[56] References Cited

U.S. PATENT DOCUMENTS

| | | | |
|---|---|---|---|
| 1,033,518 | 7/1912 | Bader | 2/10 |
| 1,161,637 | 11/1915 | Dunn | 2/199 |
| 2,615,168 | 10/1952 | Tannenbaum | 2/199 X |

FOREIGN PATENT DOCUMENTS

| | | | |
|---|---|---|---|
| 14534 | of 1908 | United Kingdom | 2/10 |

OTHER PUBLICATIONS

Gershman, "Self-Adhering Nylon Tapes," 10-1958, J.A.M.A., vol. 68, No. 7, p. 930.

*Primary Examiner*—Peter P. Nerbun

[57] ABSTRACT

In a pocket for a cap and designed to hold smaller sized personal items, the cap is formed having a head covering portion and a bill arranged forwardly thereof, the pocket is formed of a pair of liners, the inner liner comprising a segment of the head covering portion of the cap, while the outer liner is stitched proximate its edges with the underlying cap segment; a closure member foldably connecting with the upper edge of the outer liner, the closure member having Velcro disposed along its edges for securing it with the cap, and further including a snap clasp at its upper apex for firm securement of the closure member to the cap.

6 Claims, 6 Drawing Figures

CAP WITH INTEGRAL POCKET

BACKGROUND OF THE INVENTION

This invention relates generally to a cap, but more specifically pertains to a cap useful for accommodating personal items that one may need on his possession while participating in a sporting event or the like.

Various styles of headwear have long been patented, and particularly for use in various sports, such as baseball, or the like, and in addition, various types of headgear are also available for the worker, and usually have built-in features that may facilitate his performance. The current invention, unlike those in the prior art, contemplates the formation of a pocket portion at the preferably frontal segment of a cap, and having sufficient clearance so that flat type items, such as keys, coins, paper money, or the like can be easily enclosed therein, readily concealed from view, but always available for immediate usage.

It is, therefore, the principal object of this invention to provide a cap having a head covering portion that conveniently and integrally forms a pocket preferably at its frontal portion and wherein personal items can be conveniently and temporarily stored.

Another object of this invention is to provide a pocket for a cap and wherein a segment of the formed cap can function as a liner for forming part of the completed pocket.

Another object of this invention is to provide a pocket for a cap and wherein its closure member conveniently visually blends into the segmental portions of the cap, so as to be unobtrusive in appearance, but yet be available for readily accommodating any design or ornamentation that may be applied to the same at the desire of the user.

Still another object of this invention is to provide a pocket formed upon a cap and wherein fastening means may readily be provided as a snap tab that usually is customarily furnished as a button at the apex of the formed cap.

Yet another object of this invention is to provide the use of fastening means, in the nature of Velcro, that can conveniently provide secure closure for the formed pocket of a cap, and thereby prevent the untimely discharge or loss of items previously emplaced therein.

These and other objects may become more apparent to those skilled in the art upon reviewing the summary of this invention, and upon undertaking a study of the description of its preferred embodiment, in view of the drawings.

SUMMARY OF THE INVENTION

This invention contemplates the formation of a cap for use particularly by the athlete, or a worker, and which may accommodate various personal items as previously identified. The cap includes a head covering portion, incorporating the usual headband for allowing head size adjustment, and having cloth means extending upwardly therefrom for embracing the upward part of the wearer's head. But, other style caps having the usual gore in the back thereof, in place of an adjustment band, are also used with this invention. The usual bill extends outwardly from the cap, as its frontal portion, and primarily functions as a sunshade for the convenience of its wearer.

The cap includes, preferably at its frontal segment, upon the head covering portion, a formed pocket, the pocket usually being created through an integral liner, formed from the head covering portion itself, and having an outer liner stitched to it, as along its side edges and perhaps in its downward region, for forming a pocket therebetween and into which the type of aforesaid items may be located. A closure member foldably extends upwardly and integrally from this outer liner, and is designed for folding or bending rearwardly in the direction of the apex of the cap, where a clasp fastener, functioning as a fastening means, may snap the closure member into contiguity against the head covering portion of the formed cap. To further prevent the escape of any of the items located within the formed pocket, Velcro may be applied proximate the edges of the closure member, and additionally to the underlying and contiguous head covering portion, so as to provide for a temporary fastening of the closure member in place, as along these proximate edges, and to prevent the escape of any items via this location. In addition, it is likely that such fastening means, or Velcro, can be arranged along the fold line between the outer liner and the foldably connected closure member, with additional Velcro provided upon the head covering portion at a contiguous and adjacent location, so as to provide for securement of the closure member in place at this location, to provide for total closure of the pocket part as during usage of the cap.

DESCRIPTION OF THE PREFERRED EMBODIMENT

Figure 1:
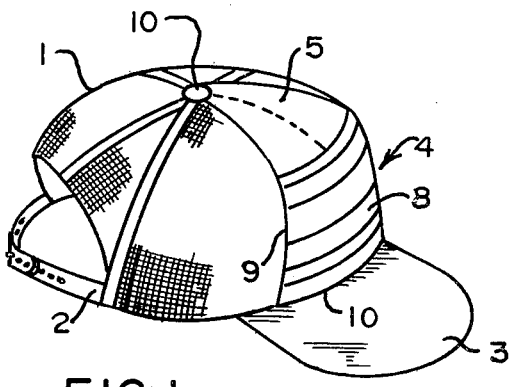
FIG. 1 discloses an isometric view of the formed cap of this invention, disclosing its pocket part along its frontal segment, just above the cap bill.
Figure 2:
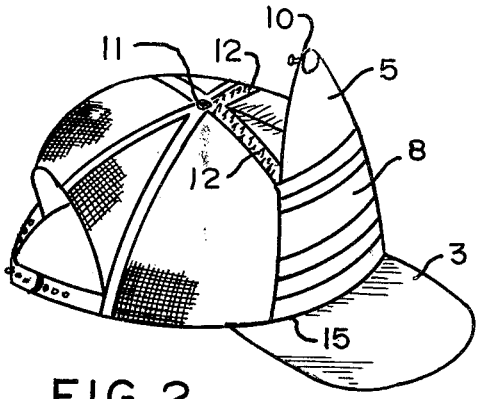
FIG. 2 discloses the cap of FIG. 1, showing the closure member having been opened and folded upwardly.
Figure 3:
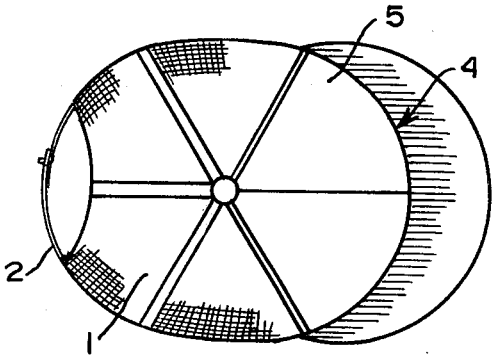
FIG. 3 provides a plan view of the cap shown in FIG. 1.

Referring to the drawings, the cap of this invention is shown in FIG. 1, comprising a head covering portion 1, of usual design, and having a head band portion 2, which is adjustable to accommodate varying head sizes, in a manner as known in the art. A bill 3 extends from the frontal portion of the cap, and a pocket is formed at the location of the front segment, as at 4, of this cap, and for use for the purpose as previously summarized. The cap, as seen in FIG. 2, includes a closure member, as at 5, which can be folded open, so as to disclose a pocket therein and where various items may be located for safekeeping, as when the cap is used by the jogger, or the like, during participation in such a sporting event. As can be seen in FIG. 3, the pocket is arranged around the frontal segment 4 of the cap, utilizing approximately one-sixth (1/6) of the surface area of the head covering portion at this location, so as to provide a pocket of some width, and which can conveniently accommodate the type of flat items as previously identified. As can also be seen in FIG. 4, the pocket, as now more specifically shown at 6, is formed between a pair of liners, the inner liner 7 comprising the underlying segment of the head covering portion 1 of the cap, while the outer liner 8 is stitched, or otherwise secured, as at 9, to the formed inner liner of the head covering portion, and in addition, the bottom edge of the pocket, formed between these two liners 7 and 8, is likewise either stitched, or foldably connected, as at 10, with each other, so as to provide closure for the formed pocket part 6 also at this location. As can be understood, the pocket is thus formed in this manner, at the formed closed edges 9 at either of its sides, while the bottom is also closed, as previously described, to provide a completely formed pocket part 6.

Figure 4:
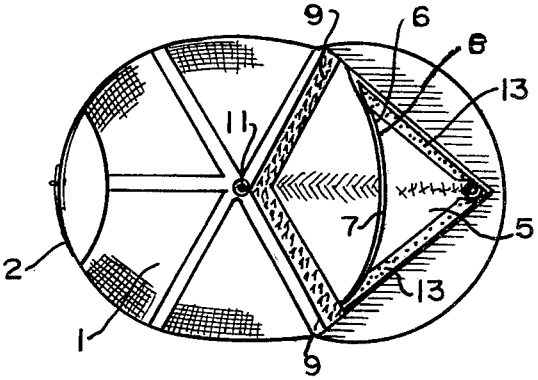
FIG. 4 discloses a plan view of the cap disclosed in FIG. 2, with the closure member being pulled further open, to disclose the formed pocket part thereat.
Figure 5:
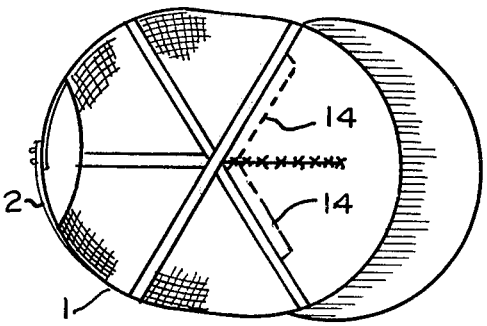
FIG. 5 provides a bottom view of the cap shown in FIG. 1.
Figure 6:
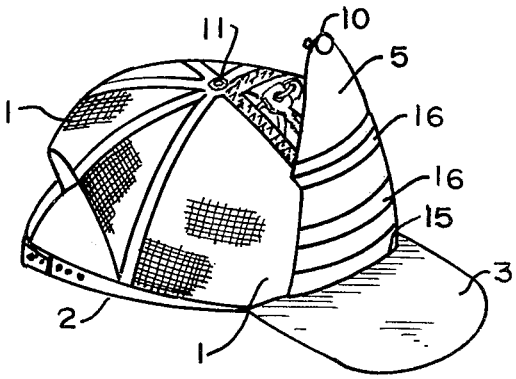
FIG. 6 discloses the cap shown in FIG. 2, with personal items, such as keys, being inserted therein for safekeeping during cap usage.

To afford closure to the formed pocket, a closure member 5, as previously explained, extends foldably and integrally upwardly from the formed outer liner 8 of the pocket part, and this closure member is principally designed for folding over into an overlying and contiguous relationship with the head covering portion 1 thereunder, as shown in FIGS. 1 and 3, with a fastening means, in this particular instance, comprising a snap fastener 10 disposed for clamping onto the bead 11, as shown in FIGS. 4 and 6. To assure the fastening of the closure member 5 upon the head covering portion of the cap, further fastening means, such as the Velcro 12, as shown, may be secured to the head covering portion, proximate the underlying surface of the above closure member 5, and in addition, the closure member 5 may likewise have corresponding edges of Velcro, comprising hook and pile fastening means, as at 13, for securing with the Velcro 12, as aforesaid, to provide for fastening of the closure member at this location, and thereby prevent the inadvertent discharge of the items contained therein. Such Velcro, as the shown strips of Velcro 12, can be conveniently stitched to each of these components, and as shown in FIG. 5, the Velcro strips 12 secure by means of the stitching 14 with the head covering portion.

In usage, closure member 5, and more specifically its fastening means 10 can be released or otherwise pulled free of the clasp 11, with the closure member then being pulled forwardly into the position as shown in FIG. 6. At this time, keys or other flat personal type items, such as coins, can be slid downwardly into the vicinity between the two liners 7 and 8, or more specifically into the pocket part 6, for safekeeping therein, with the closure member 5 then being folded back over into its overlying relationship with the head covering portion therebeneath, and with its fastening means 10 then being snapped back into position, thereby affording the securement of the strips of Velcro 12 and 13 together, to assure closure to the formed pocket part. It is to be noted that the formed pocket part extends downwardly into the vicinity of the junction between the head covering portion 1 and the bill 3 of the cap, or down to that location as depicted at the junction 15. Thus, the formed pocket has a heighth almost equivalent to the full heighth of the head covering portion 1 of the cap, and extends between the edges 9 as previously described, providing a pocket part that can conveniently hold a variety of items as desired by its wearer.

In addition, the outer surface of the outer liner 8 may be garnished with ornamentation, such as the stripes 16 as shown, or with other decals, which may entice its purchase and usage by the athlete. Such ornamentation may be determined at the choice of the designer as to what may aid in the marketability of this product. But more significantly, the facility for attachment of such ornamentation can be readily accommodated by the outer portion of this outer liner 8, as previously explained.

Variations or modifications in this invention may occur to those skilled in the art upon reviewing the subject matter of this invention. Such variations, if within the spirit of this invention, are intended to be encompassed within the scope of any claims to patent protection issuing hereon. The description of the preferred embodiment shown and described herein is done so for illustrative purposes only.

Having thus described the invention, what is claimed and desired to be secured by Letters Patent is:

1. In a pocket for a cap and designed to hold smaller size personal items such as keys, coins, or the like, as during participation in a sporting event, during working, or similar activity, comprising, said cap having a head covering portion and a bill arranged forwardly thereof, a pocket stitched to the head covering portion along a segment thereof, said pocket being formed along a frontal segment of the cap head covering portion, said pocket overlying said segment of the head covering portion, said pocket being formed of a pair of liners, one liner being the inner liner and comprising the said head covering portion segment, the other liner comprising an outer liner, and being secured with the inner liner along select edges at its periphery for forming the pocket between said liners, said liners being secured together and with the cap along their lower and side edges, with the lower edge securement being arranged proximate the location of the cap bill, and with entrance into the pocket being attained through the spacing between their separable upper edges, a closure member formed foldably connecting with the formed pocket and capable of providing a closing thereof, said closure member being foldably connected with the outer liner along its upper edge thereof, said closure member extending upwardly towards the apex of the head covering portion, a fastening means connecting with the closure member for securing it into closure after the identified type of items may be inserted therein for safekeeping, and said fastening means securing with the closure member being located at the said apex and disposed for fastening therewith.

2. The invention of claim 1 and wherein said fastening means comprising a snap fastener.

3. The invention of claim 1 and wherein said outer liner disposed for having ornamentation means thereon for enhancing the appearance of the pocketed cap.

4. The invention of claim 1 and including retention means provided upon the closure member and cooperating with retention means provided upon the underlining covering portion for securing said closure member thereon and preventing the untimely loss of items from within the said pocket.

5. The invention of claim 4 and wherein the retention means being provided along the side edges of the closure member.

6. The invention of claim 5 and wherein said retention means comprises hook and pile fastening means.

* * * * *